United States Patent [19]

Nakanishi

[11] Patent Number: 4,843,735

[45] Date of Patent: Jul. 4, 1989

[54] SHOCK ABSORBING TYPE FOOTWEAR

[75] Inventor: Motoyasu Nakanishi, Fujishi, Japan

[73] Assignee: Kabushiki Kaisha Cubic Engineering, Japan

[21] Appl. No.: 61,542

[22] Filed: Jun. 12, 1987

[51] Int. Cl.[4] ..... A43B 13/20; A43B 21/26

[52] U.S. Cl. ..... 36/28; 36/29; 36/134

[58] Field of Search ..... 36/28, 134, 127, 29, 36/37, 35 R, 35 B, 114; 128/594, 595

[56] References Cited

U.S. PATENT DOCUMENTS

| | | | |
|---|---|---|---|
| 2,641,066 | 6/1953 | Filardo | 128/594 |
| 3,739,499 | 6/1973 | Morin | 36/127 |
| 4,223,457 | 9/1980 | Borgeas | 36/37 |
| 4,227,320 | 10/1980 | Borgeas | 36/29 |
| 4,423,735 | 1/1984 | Comparetto | 128/594 |
| 4,471,538 | 9/1984 | Pomeranz et al. | 36/28 |
| 4,472,890 | 9/1984 | Gilbert | 36/29 |
| 4,502,234 | 3/1985 | Schaefer et al. | 36/28 |
| 4,561,197 | 12/1985 | Misevich | 36/28 |
| 4,616,431 | 10/1986 | Dassler | 36/28 |
| 4,768,295 | 9/1988 | Ito | 36/28 |

FOREIGN PATENT DOCUMENTS

| | | | |
|---|---|---|---|
| 0223700 | 5/1987 | European Pat. Off. | 36/127 |
| 61-55201 | 4/1986 | Japan . | |
| 2188825 | 10/1987 | United Kingdom | 36/30 R |

OTHER PUBLICATIONS

K. K. Cubic Engineering, Feb. 1, 1987, p. 70.

*Primary Examiner*—Steven N. Meyers

*Attorney, Agent, or Firm*—Wenderoth, Lind & Ponack

[57] ABSTRACT

A shock absorbing type footwear having a buffer part which is provided at a specified position of a sole, said buffer part having a buffer layer made of a gelled material and at least one space formed adjacent to this buffer layer to absorb deformation of the buffer layer. Said buffer layer can be made to have either a continuous surface or at least two independent segments.

Said buffer layer is provided below a flexible covering member which entirely covers the buffer layer and the space to absorb a shock which is caused upon each step of a foot and applied to the covering member.

7 Claims, 7 Drawing Sheets

SHOCK ABSORBING TYPE FOOTWEAR

BACKGROUND OF THE INVENTION

The present invention relates to a shock absorbing type footwear such as, for example, athletic shoes.

This type of conventional footwear has the sole made of an elastic material as used in athletic shoes and rubber-soled shoes to relieve a shock applied to a foot by a shock absorbing action owing to the elasticity of the sole.

However, a shock which is caused upon each step of feet of a running person is remarkably large and therefore a thick shoe sole is required to effectively buffer such shock. A large thickness of the shoe sole is disadvantageous in that the weight of shoes increases and it is difficult to use the shoes.

In other words, if an elastic shoe sole is used to absorb the shock, the sole absorbs the shock by elastic deformation of the part which receives the shock and therefore a repulsive force due to elastic deformation acts on the foot and a large shock cannot be fully absorbed by local deformation of a thin shoe sole. There is a problem that the shock absorbing effect of shoes cannot be demonstrated in hard sports activities.

For this reason, a person who plays hard sports games or walks for many hours everyday such as, for example, athletes or salesmen, will often suffer bone lesion, tendon inflammation, lumbago, deficiency of blood, etc. due to stresses even though they wear the shoes with elastic soles.

SUMMARY OF THE INVENTION

An object of the present invention is to provide a shock absorbing type footwear which buffers the shock applied to the sole of a foot under the condition that no repulsive elasticity is substantially caused.

This object is achieved by providing a buffer layer formed with a gelled material on the shoe sole.

Another object of the present invention is to provide a shock absorbing type footwear which provides an excellent shock absorbing effect.

This object is achieved by forming the buffer layer made of a gelled material, which is provided on the sole, as a continuous surface so that a shock applied to the buffer layer is absorbed by deformation of the whole buffer layer.

Another further object of the present invention is to provide a shock absorbing type footwear which has the buffer layer which will not be horizontally shifted due to a sudden shock applied to the buffer layer in the horizontal direction.

This object is achieved by forming said buffer layer with divided independent segments.

A shock applied to this type of buffer layer is absorbed by an original deformation of each independent segment and does not affect other independent segments.

Another further object of the present invention is to provide a buffering inter-sole which is used inside a shoe.

This inter-sole is provided with a buffer layer made of a gelled material at at least one specified part such as, for example, the heel and/or the toe, and the shoes can be the shock absorbing type by using the inter-sole in each shoe.

Another further object of the present invention is to provide a shock absorbing type footwear provided with at least one pin at the toe of the sole.

This footwear is provided with a buffer layer made of a gelled material at the toe part provided with the pin and this buffer layer is superposed with a semi-hard plate at its both sides and a hard plate is superposed to the underside of the lower semi-hard plate.

In case of this type of footwear, a shock transmitted from the pin is dispersed by the hard plate, transmitted to the buffer layer and absorbed by this buffer layer.

As the gelled material to be used in the buffer layer of the footwear according to the present invention, silicone gel is preferable and its value of penetration of approximately 50 to 200 is desirable.

Since silicone gel is expensive and its weight is heavy, it is better for practical use to make a gelled material by mixing a number of extremely small hollow particles in silicone gel.

Gelled material is deformed to absorb a shock when it receives the shock. This deformation features that it is a non-elastic deformation and a repulsive elasticity is negligible and the conductivity of shock is similar to a liquid.

Accordingly, a shock applied to the buffer layer is transmitted to at a high speed without causing a repulsive force and absorbed and therefore a shock which results in a non-repulsive elasticity to foot can be eliminated.

PREFERRED EMBODIMENT OF THE INVENTION

The following paragraphs describe the footwear in accordance with the present invention referring to the attached drawings.

Figure 1:
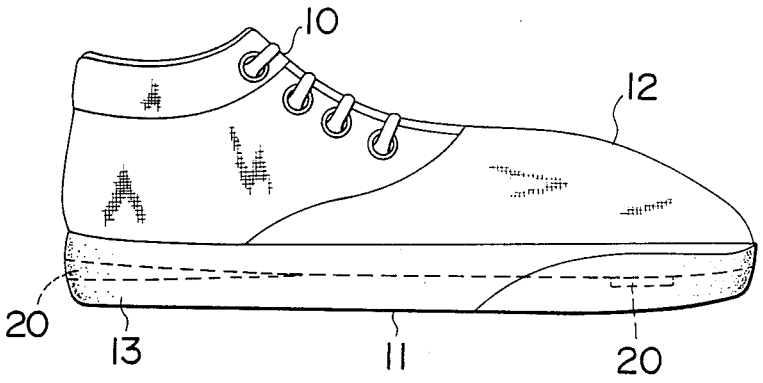
FIG. 1 is a side view showing an embodiment of the shock absorbing type footwear in accordance with the present invention.

FIG. 1 shows an athletic shoe 10 which is an embodiment of the footwear according to the present invention and this athletic shoe 10 is made up with sole 11 and a covering part such as top 12 which covers the foot instep.

Buffer part 20 provided at heel part 13 of said sole is made as a flat plate having a surface facing the foot sole.

Said buffer part 20 is provided with buffer layer 21 having a continuous surface which is made of a gelled material having the penetration value of 100 to 150, at least one space for absorbing horizontal deformation of buffer layer 21 such as, for example, hollow spaces 22 formed to divide buffer layer 21, peripheral wall 23 made of a hard or highly elastic material which surrounds the outer periphery of buffer layer 21 including said hollow spaces 22 and forms a concaved space which prevents expansion of buffer layer 21, and covering members 30 which cover upper and lower sides of said buffer layer 21 and at least one of which is made of a flexible material made of, for example, an elastic foamed material of 10 to 15 times foaming expansion. Generally, said buffer part 20 is provided inside the heel sole part.

The penetration value given here is obtained from the measurement according to JIS (Japan Industrial Standard) K 2530-1976- (50 g load).

This standard relates to the testing method for the penetration value of petroleum asphalt. The test is conducted with the load of 100 g for a specimen having the penetration value of 350 $MMX10^{-1}$ or less but the test of a gelled material is conducted with the load of 50 g.

Figure 3:
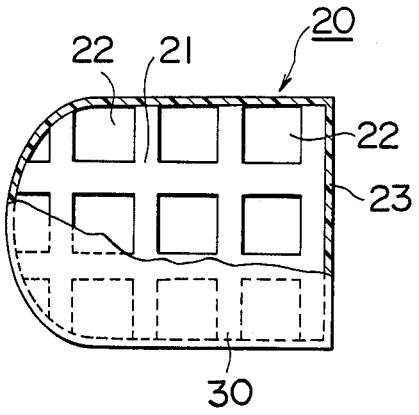
FIGS. 3 and 4 are respectively a part cutaway plan view showing an embodiment of the buffer part to be used in a footwear in accordance with the present invention.
Figure 4:
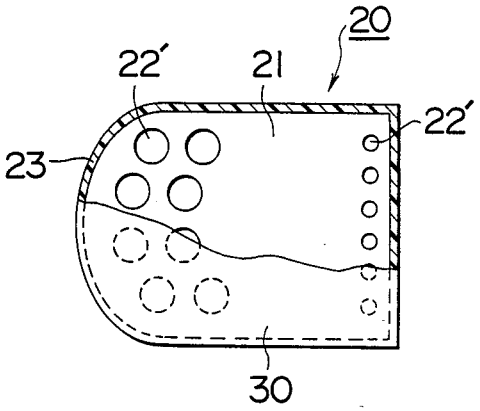

Said buffer layer 21 can be formed in the shape of lattice as shown in FIG. 3 and in the shape of flat plate as shown in FIG. 4. In either case, it is made as a continuously surfaced member to ensure satisfactory conduction of the shock.

Each of said hollow spaces 22 can be a space capable of absorbing the deformation of buffer layer 21 and accordingly, those hollow spaces can be formed in buffer layer 21 to be uniformly distributed as shown in FIG. 3 or can be provided as arrays of large and small-diameter spaces as shown in FIG. 4, or can be provided with through holes 22' or blind holes as shown in FIG. 4. In any case, said hollow spaces 22 are provided to absorb deformation of buffer layer 21 when it receives a shock.

Said peripheral wall 23 can be made integral with sole 11 because a concaved space with bottom capable of accommodating buffer layer 21 and spaces 22 can be formed. In this case, the upper surface of heel part 13 of sole 11 is made concaved and, for example, lattice type buffer layer 21 can be directly filled in this concaved part.

Said upper covering member 30 of said covering members which comes in direct contact with the foot is made of a flexible sheet at its upper side. Depending on the case, for example, in case that sole 11 is made of rubber material, it is preferable to provide the covering member made of elastic material at the lower covering member of said covering members.

As this upper covering member 30, the inside sole of the shoe can be directly used. In case the heel part is separated from the shoe sole, upper covering member 30 is provided in advance to cover the surface of buffer layer 21.

Figure 5:
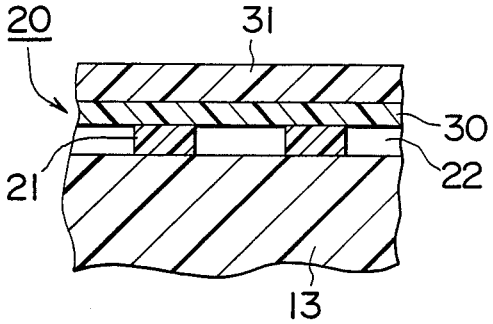
FIG. 5 is a magnified vertical sectional side view of an important part of said buffer part.

Furthermore, as the lower covering member, sole 11 can be directly used as shown in FIG. 5. In this case, the concavity can be formed on the upper surface of heel part 13 of sole 11 as described in the foregoing so that buffer layer 21 is made of a gelled material can be incorporated in this concavity.

Hereupon, reinforcing layer 31 is often provided on the upper surface of said upper covering member 30. This reinforcing layer 31 is made of soft flexible material such as cloth, polypropylene, nylon, polyester, etc. and the inside sole of the shoe can be used for this purpose.

Figure 2:
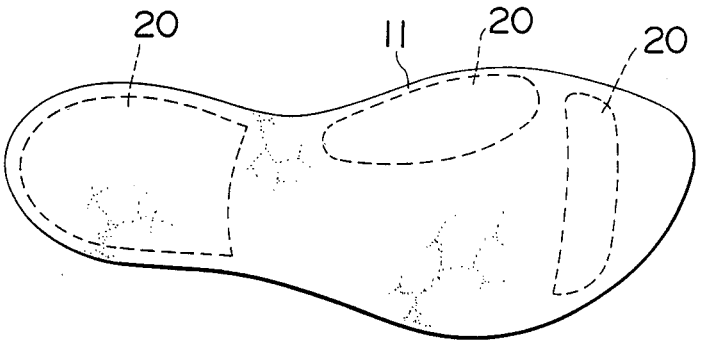
FIG. 2 is a bottom view of said embodiment.

It is generally satisfactory to provide said buffer part 20 only at the heel part but, if it is particularly required, buffer part 20 can be entirely overlapped with sole 11 or separately provided at the part as shown in FIG. 2.

In the embodiment described above, a shock produced at the heel part of the footwear sole is applied to continuous buffer layer 21 made of a gelled material to cause non-elastic deformation of this buffer layer 21.

Non-elastic deformation in this case means that the repulsive elasticity upon deformation is substantially small or negligible and is not limited to that there is no repulsive elasticity.

Gelled material instantaneously disperses the shock to the surrounding for its energy transmitting characteristics similar to liquid and accordingly the shock wave applied to the heel part is uniformly dispersed to whole buffer layer 21 and absorbed by buffer layer 21 since it is consumed as an energy which deforms buffer layer 21 during the dispersion process.

In this case, each of hollow spaces 22 of said buffer part 20 is compressed by deformation of upper covering member 30 in the direction where it receives the shock and by lateral swelling deformation of buffer layer 21 in the direction intersecting the direction of shock and therefore the capacity of each of hollow spaces 22 can be reduced so that the cushion effect when the shock is received is increased and buffer layer 21 made of a gelled material can be deformed.

Accordingly, in the footwear in accordance with the present invention, dispersed absorption of shock by non-elastic deformation of buffer layer 21 and absorption of shock by elastic repulsive of hollow spaces 22 are carried out simultaneously.

Figure 6:
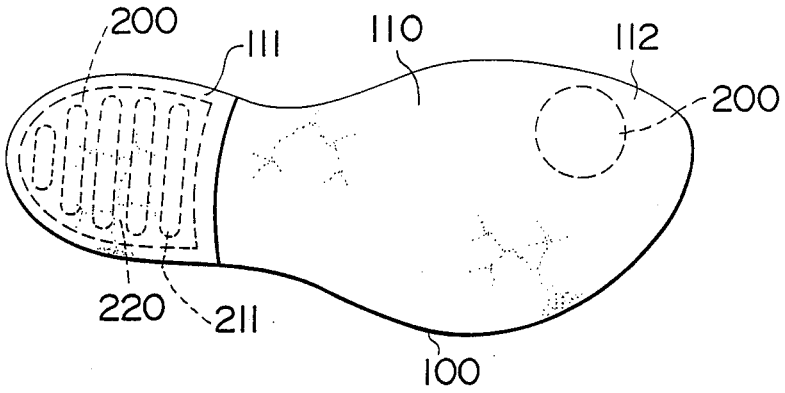
FIG. 6 is a bottom view showing another embodiment of the shock absorbing type footwear in accordance with the present invention.
Figure 7A:
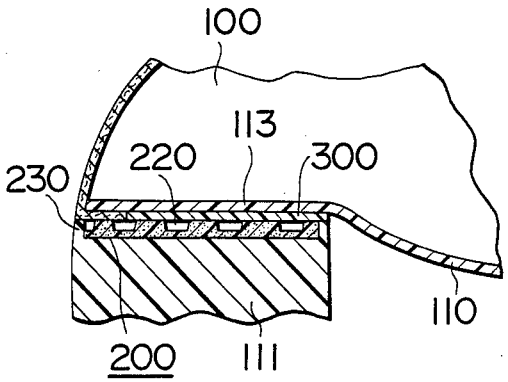
FIGS. 7A and 7B are respectively a sectional view of the heel part of the footwear in accordance with the present invention.
Figure 7B:
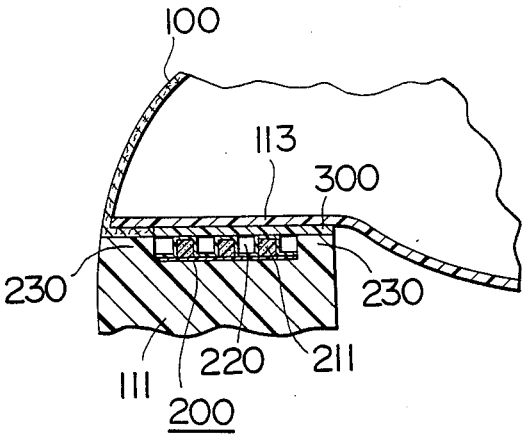

FIG. 6 shows another embodiment of the present invention, that is, sole 110 of shoe 100. In this embodiment, buffer part 200 is provided at heel 111 and toe 112. Buffer part 200 has buffer layer 210 and the spaces which form at least two independent segments 211 which are formed by dividing said buffer layer 210, for example, at least one groove 220 and is housed in the concaved space formed by peripheral wall 230.

said buffer layer 210 is provided between heel 111 and toe 112 and inside sole 113 of the shoe as shown in FIGS. 7A and 7B, and the semi-hard plate such as, for example, the receiving plate made of a plate material made by impregnating paper pulp with epoxy resin is inserted as covering member 300 between inside sole 113 and buffer layer 210.

Said buffer layer 210 is made of a gelled material with the penetration value of 50 to 200 $MMX10^{-1}$ measured according to JIS K 2530-1976- (50 g load) such as, for example, a gelled sheet material using Toray Silicone CY52 (trademark) (manufactured by Toray Silicone Kabushiki Kaisha) as a base material with a number of fine hollow particles mixed. This gelled material sheet is formed to have a number of independent divided segments made in the shape of square one side of which is, for example, approximately 5 to 10 mm.

said fine hollow particles are available as the inorganic and the organic type. Organic hollow particles have external shells made of synthetic resin and therefore they are made as elastic balls.

As such fine hollow particles are available inorganic Fillite (trademark) (manufactured by Nippon Fillite Kabushiki Kaisha) and Expancel (trademark) (sole by Nippon Fillite Kabushiki Kaisha) and 5 to 30 weight % of the former particles or 1 to 4 weight % of the latter particles is mixed in the gelled material which is the base material.

Said buffer layer 210 can be formed by providing grooves 220 in the sheet made of gelled material as shown in FIG. 7A and the gelled material sheet is completely divided as shown in FIG. 7B.

Buffer layer 210 shown in FIG. 7B is made from a sheet of gelled material sheet 210', which is made with a number of divided independent segments 211 formed by spaces specified as grooves 220 as shown in FIGS. 8A to 8D. Independent segments 211 are preferably provided to be fully separated one from another as shown in FIGS. 8A to 8D.

Such independent segments 211 are made by, for example, a kilting method but they are generally made by a heat pressing method, high frequency melting method or ultrasonic melting method.

Figure 8A:
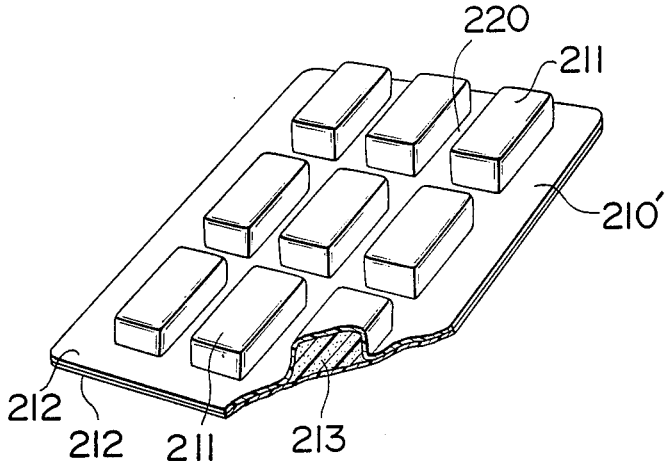
FIGS. 8A to 8D are respectively a partly cutaway perspective view showing a part of a gelled material sheet for use in the buffer layer of the footwear in accordance with the present invention.
Figure 8B:
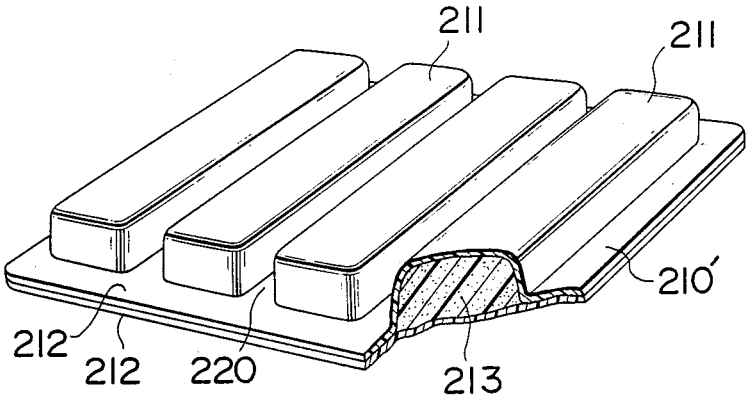
Figure 8C:
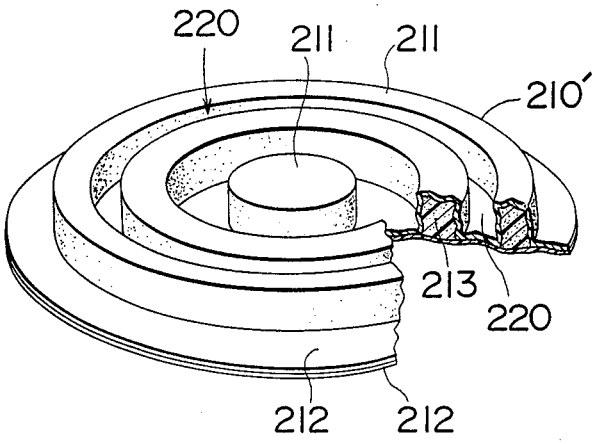
Figure 8D:
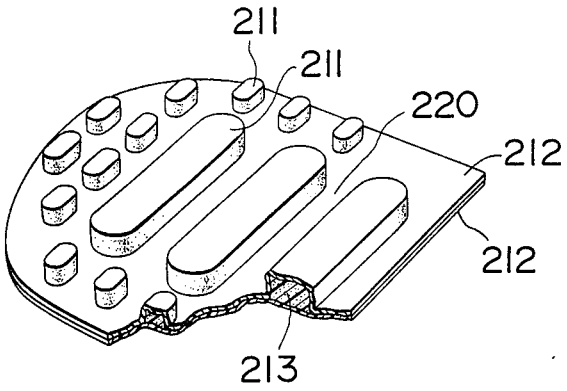
Figure 9:
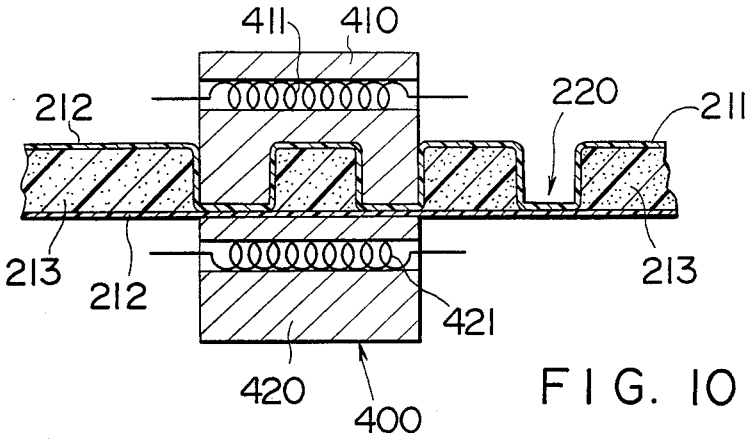
FIG. 9 is an explanatory view showing an example of the manufacturing method for the gelled material sheet shown in FIG. 8A.

Gelled material sheet 210' shown in FIGS. 8A to 8D are made by the heat pressing method shown in FIG. 9. If this heat pressing method is adopeted, gelled material 213 containing fine hollow particles can be covered with flexible external covering layer 212 the internal surface of which will be melted by heat as shown in FIG. 9 and gelled material 213 can be press-formed while dividing it by upper and lower molds 410 of heating mold 400, for example, upper mold 410 containing heater 411 and lower mold 420 containing heater 421; thus independent segments 211 are made by the press molding method and, at the same time, grooves 220 can be provided by heat-melting the parts between independent segments.

Stretchable external covering layer 212 to be used in this case can be easily made of a thermo-fusible film. If external covering layer 212 is required to have particularly specified strength, flexibility, etc., external covering layer 212 can be made a multi-layered construction with the thermal-fusible layer at the inside and the covering layer at the outside.

Urethane vinyl, foamed sheet material and unwoven cloth can be used as a material for such covering layer.

For such melting adhesion, the high frequency fixing method and the ultrasonic fixing method can be used as described above. Particularly, the latter method is advantageous in that ultrasonic oscillation is directly concentrated to the portion to be fixed by melting and the thermal-fusible layer is self-fixed by fusion due to frictional heat of molecules and therefore it provides high productivity and fusion-melting control.

Said gelled material sheet 210' can be made corresponding to each shoe but generally it is made as a long sheet and then cut into sizes suitable for various sizes of shoes.

This gelled material sheet 210' is made to form buffer layer 210 with a number of island type independent segments 211 which are separated one from another by lattice type groove 220 as shown in FIG. 8A. Independent segments 211 can be made as horizontal stripes as shown in FIG. 8B or in circular, oval or polygonal shapes.

In case endless type independent segments 211 are used, buffer layer 210 is formed by arranging independent segments 211 concentrically in the same plane as shown in FIG. 8C.

In case of the embodiment as shown in FIG. 8D, buffer layer 210 is composed of two or more types of independent segments 211 which differ in size. Thus, the buffer effect on all parts of the foot sole can be determined as required.

Figure 10:
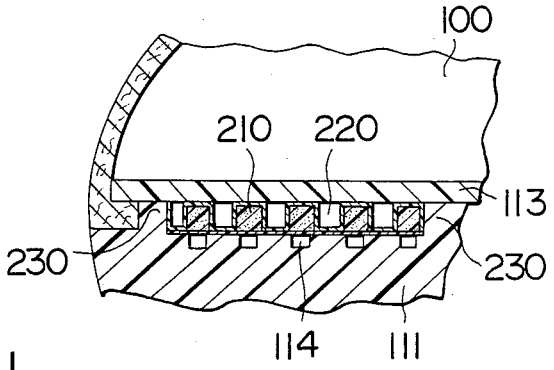
FIG. 10 is a sectional view of the heel part showing another embodiment of the footwear in accordance with the present invention.

Another embodiment of the present invention is described referring to FIG. 10 and following figures.

In the embodiment shown in FIG. 10, the surface of heel 111 of shoe 100 is molded as uneven surface 114 with a checkered pattern and the spaces for absorbing deformation of buffer layer 210 are increased by this uneven surface 114 to raise the buffering effect. This uneven surface 114 can be used as an air cushion by being covered with buffer layer 21.

Figure 11:
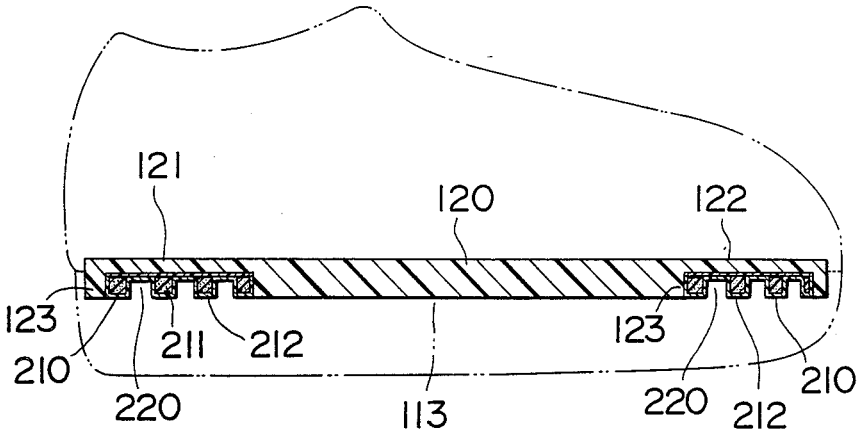
FIG. 11 is a vertical sectional side view showing an embodiment of the inter-sole for use in the footwear in accordance with the present invention.

In case of the embodiment as shown in FIG. 11, inter-sole 120 made of a freely flexible material such as, for example, an elastic sheet material is superposed to inside shoe sole 113 and is used as the sealing member and buffer part 200 is fixed to heel part 121 and toe part 122 of inter-sole 120, respectively. In this embodiment, inter-sole 120 is used as the upper covering member and provided with the concaved room having peripheral wall 123 to be open faced down, and inside shoe sole 113 or the other member is used as the lower covering member. Buffer layer 210 has external covering layer 212 made of a film of soft synthetic resin such as polyurethane or the like.

Figure 12:
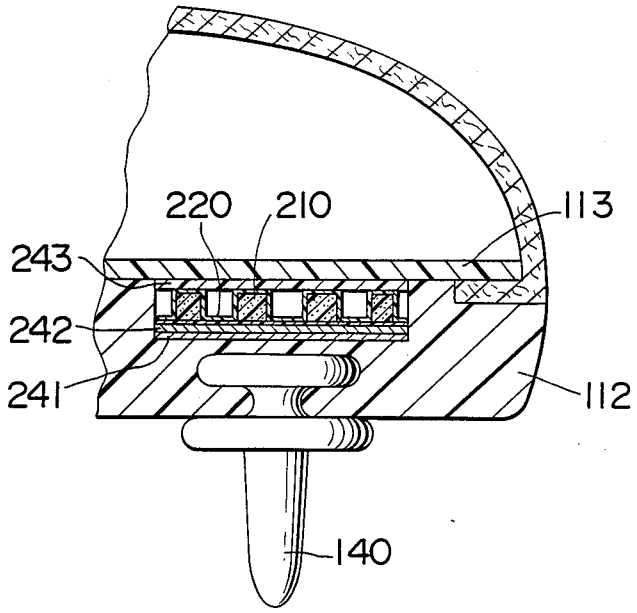
FIG. 12 is a vertical sectional side view of the toe part showing another embodiment of the footwear in accordance with the present invention.
Figure 13:
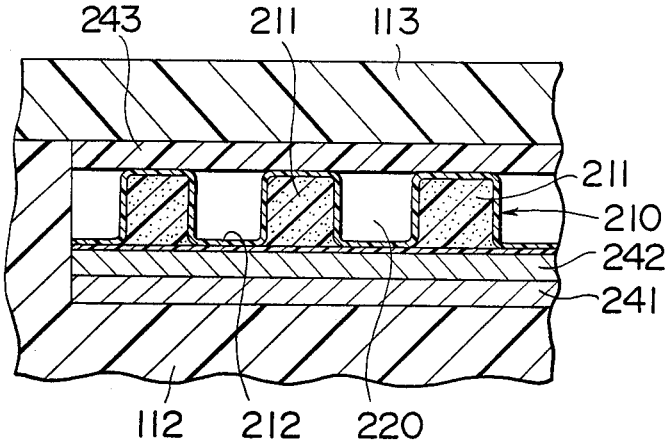
FIG. 13 is a magnified vertical sectional view showing an important part of the buffer part shown in FIG. 12.

The embodiment as shown in FIG. 12 relates to a shoe with pins such as, for example, soccer shoes, etc. It is intended to prevent pushing up by the pins used at the bottom of this type of shoe.

In case of this embodiment, buffer layer 210 is incorporated in the shape of horseshoe in toe part 112 of the shoe and arranged above at least one pin 140 as shown in FIG. 12.

In this embodiment, the lowest layer of buffer part 200 at pin 140 side is formed with hard plate 241 made of hard resin such as, for example, polyvinyl chloride resin, semi-hard plate 242 is superposed on the surface of said lowest layer, and furthermore buffer layer 210 and semi-hard plate 243 are stacked in sequence on this semi-hard plate 242. The pushing up force by said pins 140 is dispersedly transmitted to buffer layer 210 by said hard plate 241 and semi-hard plate 242.

The shoe shown in said embodiment in accordance with the present invention is provided with buffer layer 210 made of a gelled material containing fine hollow particles and therefore this shoe is advantageous in that the weight of buffer layer 210 can be reduced.

If said buffer layer 210 is composed of a number of independent segments 211 as shown in the embodiments, the movement of foot inside the shoe is received individually by independent segments 211. Therefore if the movement of foot is suddenly stopped, buffer layer 210 is prevented from being continuously deformed as a whole and buffer layer 210 will not slide in a horizontal direction. In other words, buffer layer 21 as shown in FIGS. 3 to 5 has a favorable shock dispersing effect. However, if a strong force is suddenly added to buffer layer 21 in the horizontal direction when the user suddenly stops running, buffer layer 21 may slide aside and deviate but buffer layer 210 as shown in FIGS. 8A to 8D can prevent the gelled material from sliding aside.

In addition, silicone gel is generally used as the gelled material for use in said buffer layers 21 and 210. Since the weight of silicone gel is large and expensive, mixing of fine hollow particles is effective when increasing the thickness of buffer layers 21 and 20 or using a plurality of buffer layers.

Though the above embodiments show the athletic shoe, the present invention is not limited to the above embodiments and can be embodied on other types of footwear such as other shoes, sandals, etc.

The present invention allows a number of variations as far as these variations do not deviate from the scope of claims for the patent.

What is claimed is:

1. A shock absorbing type footwear comprising a covering part which covers a human foot, a sole having, at its toe part, at least one buffer part comprising (a) a buffer layer made of a gelled material, (b) at least one space which is provided adjacent to the side of said buffer layer to absorb expansion and deformation of said buffer layer in a horizontal direction, (c) a peripheral wall for forming a space which surrounds said buffer layer and said space, (d) semi-hard plates arranged at both upper and lower sides of said buffer layer, (e) a covering member made of a flexible material to cover the surface of the upper one of said semi-hard plates, and (f) a hard plate which is superposed on the underside of the lower semi-hard plate of said semi-hard plates, and at least one pin which is fixed on the underside of the toe part of said sole so that it is positioned below the hard plate of said buffer part, wherein a shock conducted from said pin is dispersedly conducted to said buffer layer by said hard plate.

2. A footwear in accordance with claim 1, wherein said buffer layer is made of a gelled material having a penetration value of 50 to 200 $MMX10^{-1}$.

3. A footwear in accordance with claim 1, wherein the gelled material of said buffer layer is silicone gel.

4. A footwear in accordance with claim 1, wherein fine hollow particles are mixed in said gelled material.

5. A footwear in accordance with claim 4, wherein 1 to 4 weight % of organic fine hollow particles is mixed in said gelled material.

6. A footwear in accordance with claim 4, wherein 5 to 30 weight % of inorganic fine hollow particles is mixed in said gelled material.

7. A footwear in accordance with claim 1, wherein said buffer layer is covered by a flexible external covering layer.

* * * * *